US005570749A

United States Patent [19]

Reed

[11] Patent Number: 5,570,749

[45] Date of Patent: Nov. 5, 1996

[54] DRILLING FLUID REMEDIATION SYSTEM

[75] Inventor: Lowell M. Reed, Moore, Okla.

[73] Assignee: Onsite Technology, L.L.C., Tulsa, Okla.

[21] Appl. No.: 539,259

[22] Filed: Oct. 5, 1995

[51] Int. Cl.[6] ..... E21B 21/06

[52] U.S. Cl. ..... 175/66; 175/206; 175/207; 210/180; 210/770; 210/803

[58] Field of Search ..... 175/66, 206, 207; 210/175, 174, 180, 770, 787, 803, 804; 405/128

[56] References Cited

U.S. PATENT DOCUMENTS

| | | | |
|---|---|---|---|
| 2,313,956 | 3/1943 | McGrane . | |
| 2,650,084 | 8/1953 | White . | |
| 3,740,861 | 5/1973 | Myers . | |
| 3,766,997 | 10/1973 | Heilhecker et al. . | |
| 3,860,019 | 1/1975 | Teague . | |
| 4,040,866 | 8/1977 | Mondshine . | |
| 4,047,883 | 9/1977 | Waters . | |
| 4,070,765 | 1/1978 | Hovmand et al. . | |
| 4,139,462 | 2/1979 | Sample, Jr. . | |
| 4,181,494 | 1/1980 | Kimberly . | |
| 4,304,609 | 12/1981 | Morris | 175/206 X |
| 4,402,274 | 9/1983 | Meenan et al. . | |
| 4,411,074 | 10/1983 | Daly | 175/207 X |
| 4,463,691 | 8/1984 | Meenan et al. . | |
| 4,683,963 | 8/1987 | Skinner | 175/66 |
| 4,685,220 | 8/1987 | Meenan et al. . | |
| 4,699,721 | 10/1987 | Meenan et al. . | |
| 4,778,606 | 10/1988 | Meenan et al. . | |
| 4,793,937 | 12/1988 | Meenan et al. . | |
| 4,872,949 | 10/1989 | Wilwerding | 175/66 X |
| 4,913,245 | 4/1990 | Skinner | 175/66 |
| 5,090,498 | 2/1992 | Hamill | 195/206 |
| 5,129,468 | 7/1992 | Parmenter | 175/66 |
| 5,273,629 | 12/1993 | Meenan et al. . | |
| 5,454,957 | 10/1995 | Roff, Jr. | 175/664 |

*Primary Examiner*—George A. Suchfield
*Attorney, Agent, or Firm*—Head, Johnson & Kachigian

[57] ABSTRACT

A method and apparatus for removing and treating hydrocarbon-contaminated drill cuttings suspended in drilling mud so that the cuttings are made environmentally acceptable while the hydrocarbon contaminants are contemporaneously captured and returned for use in said drilling mud is disclosed. Using one or more shakers to make a first separation of the cuttings from the mud, a mud stream and a first slurry containing cuttings are produced. The mud stream is fed into a mud pit, while the first slurry is fed into a classifier/grit dewatering unit to separate the cuttings from the slurry to obtain a drill solids discharge. The drill solids discharge is passed into a rotating, heat-jacketed trundle for a time and at a temperature sufficient to vaporize the hydrocarbon contaminants to obtain processed solids and hydrocarbon vapors. The hydrocarbon vapors are captured and condensed to obtain a liquid hydrocarbon, which is delivered to the mud pit for admixture with the mud stream.

5 Claims, 2 Drawing Sheets

DRILLING FLUID REMEDIATION SYSTEM

BACKGROUND OF THE INVENTION

1. Technical Field

The present invention relates generally to the treatment of drilling fluids, and more specifically, to a method and apparatus for treating hydrocarbon-contaminated cuttings removed from drilling mud so that the cuttings are made environmentally acceptable while the hydrocarbon contaminants are contemporaneously captured and returned for reuse in the drilling mud.

2. Background

In the conventional rotary drilling of oil wells, gas wells, and similar boreholes, a drilling derrick is mounted on a platform for drilling a well into the substratum. A drill pipe having a drill bit at its lower end is connected to a rotary table and draw works associated with the derrick. A drilling fluid is continuously pumped down through the middle of the drill pipe into the bottom of the borehole and through the drill bit. The fluid eventually returns to the surface, passing upwardly through the annulus defined by the rotating drill string and the borehole. As the drill bit cuts into the earth, the drill cuttings are carried by the fluid to the surface.

The drilling fluid, referred to as "mud," serves several functions, the most important of which includes cooling and lubricating the bit and removing drilled solids, or cuttings, from the borehole. While it is essentially a water based, flowable composition, the drilling mud is frequently compounded with a lubricant material such as diesel, crude oil, or another non-water soluble petroleum based constituent to facilitate the mud's lubricating characteristics.

The mud is usually contained in a mud pit, which is connected by way of a mud line and mud pump to a hose and swivel used to inject the mud into the top of the drill pipe. The returning mud, combined with cuttings, is captured in a mud return pipe. For obvious reasons, it is advantageous to recirculate the drilling mud through the drill pipe.

Recirculation of the mud becomes problematic, however, when the concentration of drill cuttings in the mud rises too high. In order for the drilling mud to perform its several functions, its viscosity, density and other properties must be maintained within acceptable limits. If permitted to accumulate in the system, the drill cuttings adversely affect these properties, reducing the carrying capacity of the mud and damaging drilling equipment, among other things.

To allow for effective recirculation, the mud may be separated from the cuttings prior to being recycled through the drill string. The cuttings are then disposed of as waste. Unfortunately, in the situation where the lubricating properties of the mud have been improved by the addition of hydrocarbons, the cuttings are contaminated, having been mixed with, and coated by, the hydrocarbons commingled in the mud. This presents a hazardous waste problem. Historically, the hydrocontaminated cuttings were diluted by mixing and hauled to remote sites for disposal in landfills.

Decontaminating the cuttings has known advantages. Treatment processes heretofore available to remove oil or other hydrocarbons from cuttings include distillation, solvent washing, and mud burning. While these processes are effective to varying degrees at stripping the hydrocarbon contaminants from cuttings, rendering the cuttings environmentally clean, they remain problematic in that a disposal problem persists with respect to the liquid or vapor form of the disassociated contaminant.

It is an object of this invention to improve the treatment of drilling mud to render environmentally safe, disposable drill cuttings, while contemporaneously capturing, controlling and recycling the disassociated hydrocarbon contaminants.

It should be understood, however, that although the invention is particularly useful in remediating drilling fluids, as described above, it is in no way limited to this application. The invention is also effective in the remediation and reclamation of a broad spectrum of petrochemical contaminants and hydrocontaminated soils. The invention may be used to remediate oil contaminated soil around tank batteries and refineries, as well as cleaning spills due to pipe line breaks or tanker truck accidents. Soil around military installations and rig-up yards may also be remediated by the present invention, as well as former drilling sites. The invention can also be used to prepare old filling station locations, refineries and industrial sites for full remediation.

SUMMARY OF THE INVENTION

According to the present invention, the foregoing and other objects and advantages are attained by treating hydrocarbon-contaminated soil by first isolating the hydrocontaminated soil by shaking and sedimentation to obtain an isolated contaminated soil. The isolated contaminated soil is heated in a rotating, heat-jacketed trundle for a time and at a temperature sufficient to vaporize substantially all hydrocarbon contaminants, rendering a processed soil and hydrocarbon vapors. The vapors are then captured and condensed.

In accordance with one aspect of the invention, hydrocarbon-contaminated drill cuttings suspended in drilling mud are removed and treated so that the cuttings are made environmentally acceptable while the hydrocarbon contaminants are contemporaneously captured and returned for use in the drilling mud. Using one or more shakers to make a first separation of the cuttings from the mud, a mud stream and a first slurry containing cuttings are produced. The mud stream is fed into a mud pit, while the first slurry is fed into a classifier/grit dewatering unit to separate the cuttings from the slurry to obtain a drill solids discharge. The drill solids discharge is passed into a rotating, heat-jacketed trundle for a time and at a temperature sufficient to vaporize the hydrocarbon contaminants to obtain processed solids and hydrocarbon vapors. The hydrocarbon vapors are captured and condensed to obtain a liquid hydrocarbon, which is delivered to the mud pit for admixture with the mud stream.

In accordance with another aspect of the invention, the mud pit has a plurality of bins divided by mud return equalizers for the progressive movement of the mud stream through a desander, a desilter, and a mud cleaner. In this case, the classifier/grit dewatering unit is adapted to receive effluent from the desander, desilter, and mud cleaner and to further separate the effluent. The dewatering unit has a variable speed motor driving screw feeder to move the drill solids discharge from the unit, and the unit is further adapted to connect to a centrifuge pump for returning settled mud to the mud cleaning pit.

The present invention has several advantages over other conventional hydrocontaminant treatment modalities. The present invention uses indirect thermal desorption to remove liquid hydrocontaminants from soil in a unique on-site system. Because the invention treats soil on-site, expensive and dangerous hauling of contaminated material through populated areas is eliminated. Additionally, contaminated soil is not required to be placed at the hazardous material landfills.

Before now, some contaminated soil locations have been left unattended, due to the cost of remediation. The present invention is cost effective and has made clean-up at locations like refineries, pipeline spills, rig-up yards, abandoned tank batteries, military installations, old filling stations and former drilling-sites, efficient and cost effective.

Besides being completely portable, eliminating the need for expensive and dangerous hauling, dumping or incineration of waste, the present invention serves to eliminate on-site latent liability for hydrocarbon contaminated material through its desorption process. Using this process, up to 90% of the hydrocarbon contaminates in the treated soil are recoverable and recyclable. Operators no longer will have to face the obstacle of locating a disposal facility to store contaminated soils, and then worry about continuous liability for years to come. Problem soil is taken care of on-site, efficiently and cost effectively.

The present invention also provides drilling rig operators with the flexibility to use a variety of drilling fluids. Operators will no longer be limited to the use of certain drilling fluids for ecological reasons, as the present invention cleans hydrocarbon-saturated drill cuttings and converts them into an environmentally safe product. This provides the engineer with more design options and the potential for significant cost savings.

For the remediator, the present invention is ideally suited for transport to multiple locations. Since the system is entirely portable, the unit can be moved from site to site on an as-needed basis. Contaminated soil can be stored on location and then processed quickly and efficiently before the unit moves on to the next location. The system is mobilized in a few hours, and quickly eliminates existing hydrocarbon contaminants. The speed is especially welcome for those involved with timely site closure or abandonment.

Since the system is a closed system, all of the contaminates can be contained and recondensed in the closed environment for recycling or future disposal. Also, a thermal oxidizer can be used to thermally destroy unwanted VOC's.

In addition, as the invention uses indirect thermal desorption, no flame is exposed to the material. Consequently, highly contaminated soils can be processed, making expensive dust scrubbers and after burners unnecessary. A countercurrent flow (direction of heat versus soil movement) increases the efficiency of soil desorption and produces high soil temperature upon discharge. This insures clean soil well below the TPH and BTEX remediation levels allowed.

The present invention may also utilize a variety of fuel sources. Propane or natural gas burners can be used to provide clean, efficient and reliable heat energy to the remediation system. If desired, tire vaporizers can be used to generate heat energy when it has proven economically feasible.

No noxious vapors or health hazards exist in connection with the use of the system, allowing operation in urban settings. Hydrocarbon contaminated soils with contaminants ranging from gasoline to heavy waste oils may be processed, at levels exceeding 300,000 ppm.

Still other objects and advantages of the present invention will become readily apparent to those skilled in this art from the following detailed description, wherein there is shown and described only the preferred embodiment of the invention, simply by way of illustration of the best mode contemplated for carrying out the invention. As will be realized, the invention is capable of modifications in various obvious respects, all without departing from the invention. Accordingly, the description should be regarded as illustrative in nature, and not as restrictive.

DETAILED DESCRIPTION OF THE PREFERRED EMBODIMENT

Figure 1:
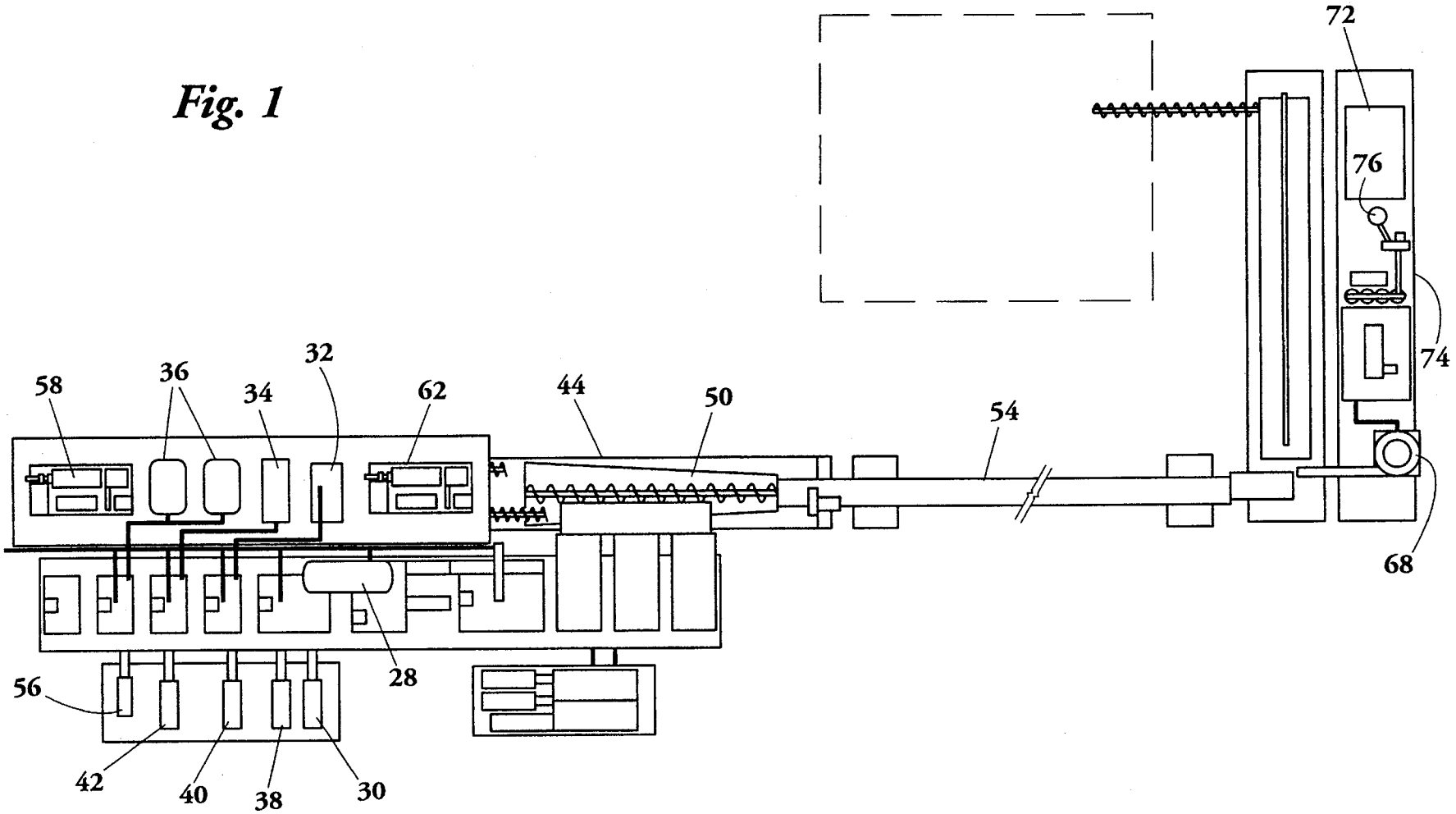
FIG. 1 is a processing layout showing the preferred method and apparatus of the invention.
Figure 2:
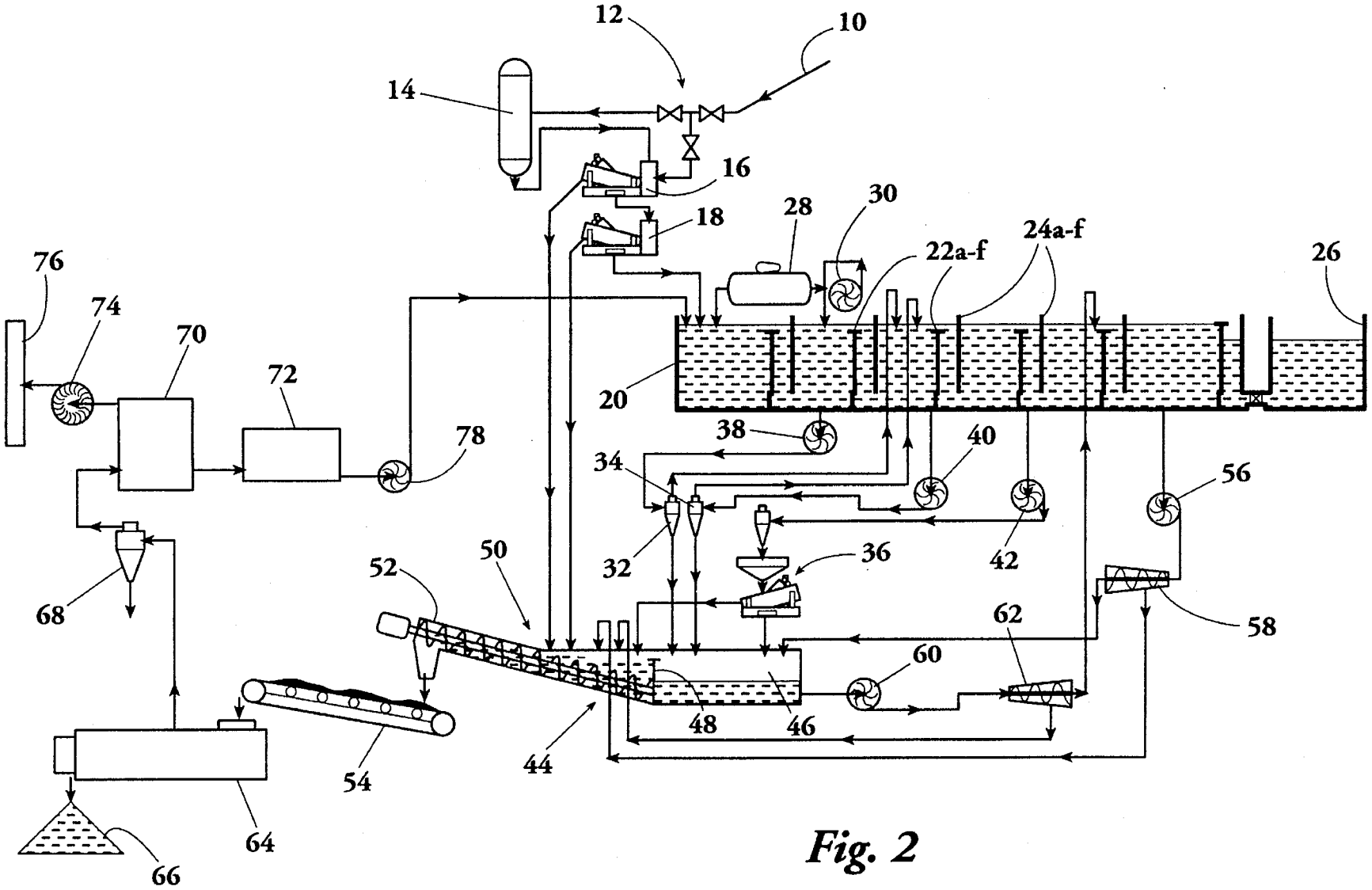
FIG. 2 shows the processing geometry of the preferred method and apparatus.

Referring now to FIGS. 1 and 2, a mixture of drilling mud and drill cuttings are carried to the invention by a mud return pipe 10. At a valve junction 12 the mixture may be routed to either a gas buster 14 or a scalping shaker 16. If the mixture is routed through the gas buster 14, it is discharged into the scalping shaker 16. The scalping shaker 16 is aligned in series with a linear motion shaker 18. The function of the scalping shaker 16 and the linear motion shaker 18 are to perform a first separation of the drill cuttings from the mud to obtain 1) a mud stream and 2) a first slurry containing the cuttings.

The mud stream produced by the tandem of the scalping shaker 16 and the linear motion shaker 18 is fed into a mud cleaning pit 20.

The mud cleaning pit 20 has a plurality of bins divided by mud return equalizers 22*a–f* and partial walls 24*a–f*. The mud return equalizers 22*a–f* are each provided with a gate located at their end adjacent to the bottom of the mud cleaning pit 20. The equalizers 22*a–f* are designed to backflow for proper mud cleaning. The top of equalizers 22*a–f* are located approximately four inches below the mud cleaning level. The mud return equalizers 22*a–f* and the partial walls 24*a–f* provide for the progressive movement of the mud stream through the mud cleaning pit 20 to a working mud area 26.

Several supporting components may be adapted to the mud cleaning pit 20. Preferably, the mud cleaning pit 20 is provided with a degasser 28, which circulates a slipstream of mud taken from the first bin of the mud cleaning pit 20. A degasser pump 30 is adapted to connect to the degasser 28 to provide the required circulation.

The mud cleaning pit 20 may also be provided with a desander 32, a desilter 34 and a mud cleaner 36. Each of these devices is provided with a corresponding pump, respectively, a desander pump 38, a desilter pump 40 and a mud cleaner pump 42.

The desander 32, desilter 34, and mud cleaner 36 are arranged such that each accepts a slipstream of mud from the mud cleaning pit 20 and produces two outflow streams. Both desander 32 and desilter 34 output a light liquid stream (or "light" slurry) back into the mud cleaning pit 20. The second outflow from the desander 32 and desilter 34 is of a slurry that contains solids (a "heavy" slurry). The heavy slurry outflow from the desander 32 and defilter 34, along with the outflow from the mud cleaner 36, are processed as further described below.

There is provided with the present invention a classifier/grit dewatering unit, generally indicated by the reference numeral 44, which is designed to separate liquids from solids by sedimentation. The dewatering unit 44 is compartmented, as it includes an effluent tank 46 for use as a holding buffer separated by a baffle 48 from a forward-facing, inclined sedimentation portion 50. The sedimentation portion 50 of the classifier/grit dewatering unit 44 is provided with a variable speed inclined driving screw feeder 52 (or discharge auger) to move sedimented solids from the classifier grit dewatering unit 44 to a conveyor belt/stacker 54.

The first slurry containing drill cuttings discharged from the shakers 16, 18 and the cutting containing slurry discharged from mud cleaner 36 are fed into the sedimentation portion 50 of the dewatering unit 44. There, sedimentation works to separate the hydrocarbon containing solids, or drill cuttings, from the lighter, more liquid drilling mud components. The heavy slurry from the desander 32 and desilter 34, along with a "light" stream from mud cleaner 36, are discharged into the effluent tank 46.

If weighted mud is being used another slipstream can be taken from the mud cleaning pit 20 and routed through a first centrifuge feed pump 56 to a first centrifuge 58, where two outflow streams are generated. The lighter of the two outflow streams is discharged into the effluent tank 46, while the heavier of the two streams is discharged into the sedimentation portion 50 of the dewatering unit 44.

A second centrifuge pump 60 is connected to the lower portion of the effluent tank 46 to move sedimented matter to a second centrifuge 62 for barite removal and dewatering. The second centrifuge 62 produces two outflow streams, the lighter of which is routed to mud cleaning pit 20 and the heavier of which is routed to the sedimentation portion 50 of the dewatering unit 44.

The discharge auger 52 generates a drill solids discharge from the sedimentation portion 50 of the dewatering unit 44. The sedimented drill solids discharge is moved by the conveyor belt/stacker 54 to a rotating, heat-jacketed trundle 64. The trundle 64 can vary in size, a small trundle measuring approximately 4×32 feet and being capable of processing 50 tons of drill solids discharge per day, and a large trundle measuring approximately 8×36 feet and being capable of processing up to 200 tons of drill solids discharge per day. The trundle 64 uses indirect thermal desorption for hydrocarbon reclaimation. External heat at approximately 900° to 1400° F. (2 million BTU/hour) is delivered to a heat jacket which transfers heat in amounts sufficient to elevate the internal soil temperature to 300° to 900° F. Exit soil temperatures are held between 3000°–500° F. Soil transit time is regulated by rotation, inclination and feed rate and averages 20 to 40 minutes.

After the drill solids discharge has been in residency in the trundle 64 for a time and at a temperature sufficient to vaporize the hydrocarbon contaminates, there is recovered processed solids, indicated by the reference numeral 66, and hydrocarbon vapors. The processed solids 66 are in a remediated condition such that disposal is environmentally acceptable.

The hydrocarbon vapors generated by the trundle 64 are captured and moved through a dust scrubber 68. From dust scrubber 68, the hydrocarbon vapors are routed to a condenser unit(s) 70. The condenser trait 70 condenses the hydrocarbon vapors to obtain a liquid hydrocarbon which is routed to an oil reclamation tank 72. An exhaust fan 74 and exhaust stack 76 are connected to the condenser unit 70 for managing the exhaust from condenser unit 70. The liquid hydrocarbon condensed in the condenser unit 70 may be delivered back to the mud cleaning pit 20 from oil reclaimation tank 72 via pump 78.

Thus, there has been provided a method and apparatus for removing and treating hydrocarbon-contaminated drill cuttings suspended in drilling mud so that the cuttings are made environmentally acceptable while the hydrocarbon contaminates are contemporaneously captured and returned for use in the drilling mud.

An organic analysis report of volatile aromatics and total petroleum hydrocarbons, based upon Method Reference No. EPA 602/610, confirms the efficacy of the treatment of hydrocontaminated drill cuttings utlizing a rotating, heat-jacketed trundle.

A pre-run of an untreated batch of drilling mud at a test site yielded the following analytical results:

ANALYTICAL RESULTS — BTX & TPH
Units = mg/kg (ppm)
Untreated Batch

| Compound: | Detection Limit: | Amount Detected: |
|---|---|---|
| Benzene | 0.1 | <0.1 |
| Toluene | 0.1 | 0.9 |
| Ethylbenzene | 0.1 | 0.8 |
| Total Xylene | 0.1 | 18. |
| Total Petroleum Hydrocarbons | 2.0 | 54,000 † |

The same batch treated in accordance with the present invention showed nearly complete hydocarbon remediation.

ANALYTICAL RESULTS — BTX & TPH
Units = mg/kg (ppm)
Treated Batch

| Compound: | Detection Limit: | Amount Detected: |
|---|---|---|
| Benzene | 0.1 | <0.1 |
| Toluene | 0.1 | <0.1 |
| Ethylbenzene | 0.1 | <0.1 |
| Total Xylene | 0.1 | <0.1 |
| Total Petroleum Hydrocarbons | 2.0 | 20. |

<Value = None detected above the specified method detection limit, or a value that reflects a reasonable limit due to interferences.
T Trace. Detectable amount is lower than the practical quantitation limit for this compound.
† The TPH value expressed includes compounds in the molecular weight range of 75 to 300. Evidence of higher weight compounds is present, but a quantitative representation of that amount is not possible under the constraints imposed by the methodology used for the analysis.

In another study, a pre-run of a solids sample was reported as:

ANALYTICAL RESULTS — BTX & TPH
Units = mg/kg (ppm)
Untreated

| Compound: | Detection Limit: | Amount Detected: |
|---|---|---|
| Benzene | 0.1 | 0.3 |
| Toluene | 0.1 | 1.0 |
| Ethylbenzene | 0.1 | 0.5 |
| Total Xylene | 0.1 | 6.8 |
| Total Petroleum Hydrocarbons | 2.0 | 132,000. |

Treatment in accordance with the present invention yielded a remediated drill solid.

ANALYTICAL RESULTS — BTX & TPH
Units = mg/kg (ppm)
Treated

| Compound: | Detection Limit: | Amount Detected: |
|---|---|---|
| Benzene | 0.1 | <0.1 |
| Toluene | 0.1 | <0.1 |
| Ethylbenzene | 0.1 | <0.1 |
| Total Xylene | 0.1 | <0.1 |
| Total Petroleum Hydrocarbons | 2.0 | 74. |

<Value = None detected above the specified method detection limit, or a value that reflects a reasonable limit due to interferences.
T Trace. Detectable amount is lower than the practical quantitation limit for this compound.

Still another test confirmed the efficacy of the present invention. The pre-run on an untreated solids discharge was as follows:

| ANALYTICAL RESULTS Units = mg/kg (ppm) Untreated | BTX & TPH | |
|---|---|---|
| Compound: | Detection Limit: | Amount Detected: |
| Benzene | 0.1 | <0.1 |
| Toluene | 0.1 | <0.1 |
| Ethylbenzene | 0.1 | <0.1 |
| Total Xylene | 0.1 | <0.1 |
| Total Petroleum Hydrocarbons | 2.0 | 140,000. |

After treatment, there was full remediation.

| ANALYTICAL RESULTS Units = mg/kg (ppm) Treated | BTX & TPH | |
|---|---|---|
| Compound: | Detection Limit: | Amount Detected: |
| Benzene | 0.1 | <0.1 |
| Toluene | 0.1 | <0.1 |
| Ethylbenzene | 0.1 | <0.1 |
| Total Xylene | 0.1 | <0.1 |
| Total Petroleum Hydrocarbons | 2.0 | <2.0 |

<Value = None detected above the specified method detection limit, or a value that reflects a reasonable limit due to interferences.
† All compounds are reported on a dry weight basis.

While the invention has been described with a certain degree of particularity, it is manifest that many changes may be made in the method hereinabove described without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method for removing and treating hydrocarbon-contaminated drill cuttings suspended in drilling mud so that the cuttings are made environmentally acceptable while the hydrocarbon contaminates are contemporaneously captured and returned for use in said drilling mud, comprising the steps of:

(a) using one or more shakers to make a first separation of said cuttings from said mud to obtain (1) a mud stream and (2) a first slurry containing said cuttings;

(b) feeding said mud stream into a mud pit;

(c) feeding said first slurry into a classifier/grit dewatering unit to separate said cuttings from said slurry by sedimentation to obtain a drill solids discharge;

(d) passing said drill solids discharge into a rotating, heat-jacketed trundle for a time and at a temperature sufficient to vaporize said hydrocarbon contaminants to obtain (1) processed solids and (2) hydrocarbon vapors;

(e) capturing and condensing said hydrocarbon vapors to obtain a liquid hydrocarbon; and (f) delivering said liquid hydrocarbon to said mud pit for admixture with said mud stream.

2. A method for removing and treating hydrocarbon-contaminated drill cuttings suspended in drilling mud so that the cuttings are made environmentally acceptable while the hydrocarbon contaminants are contemporaneously captured and returned for use in said drilling mud, comprising the steps of:

(a) passing a mixture of said mud and said cuttings through a gas buster;

(b) using one or more shakers to make a first separation of said cuttings from said mud to obtain (1) a mud stream and (2) a first slurry containing said cuttings;

(c) feeding said mud stream into a mud cleaning pit, said mud cleaning pit having a plurality of bins divided by mud return equalizers for the progressive movement of said mud stream through a desander, a desilter, and a mud cleaner;

(d) feeding said first slurry into a classifier/grit dewatering unit to separate said cuttings from said slurry to obtain a drill solids discharge, said dewatering unit also being adapted to receive effluent from said desander, said desilter, and said mud cleaner and further separate said effluent, said dewatering unit having a variable speed motor driving screw feeder to move said drill solids discharge from said unit and said unit being adapted to connect to a centrifuge pump for returning settled mud to said mud cleaning pit;

(e) passing said drill solids discharge into a rotating, heat-jacketed trundle for a time and at a temperature sufficient to vaporize said hydrocarbon contaminants to obtain (1) processed solids and (2) hydrocarbon vapors;

(f) capturing and routing said hydrocarbon vapors through a dust scrubber;

(g) condensing said hydrocarbon vapors to obtain a liquid hydrocarbon; and (h) pumping said liquid hydrocarbon to said mud cleaning pit for admixture with said mud stream.

3. The method of claim 2 wherein said drill solids discharge is heated to 300°–900° F.

4. An apparatus for use in removing and treating hydrocarbon-contaminated drill cuttings suspended in drilling mud so that the cuttings are made environmentally acceptable while the hydrocarbon contaminants are contemporaneously captured and returned for use in said drilling mud, comprising:

(a) means for separating a flow of a mixture of said mud and said cuttings into (1) a mud stream and (2) a first slurry containing said cuttings;

(b) a holding tank for receiving said mud stream;

(c) a classifier/grit dewatering unit for receiving said slurry and separating said cuttings from said slurry to obtain a drill solids discharge;

(d) means for receiving and heating said drill solids discharge for a time and at a temperature sufficient to vaporize said hydrocarbon contaminants to obtain (1) processed solids and (2) hydrocarbon vapors;

(e) means to capture said hydrocarbon vapors;

(f) a condenser for condensing said hydrocarbon vapors to obtain a liquid hydrocarbon; and (g) means for transporting said liquid hydrocarbon from said condenser to said holding tank for admixture with said mud stream.

5. An apparatus for use in removing and treating hydrocarbon-contaminated drill cuttings suspended in drilling mud so that the cuttings are made environmentally acceptable while the hydrocarbon contaminants are contemporaneously captured and returned for use in said drilling mud, comprising:

(a) one or more shakers adapted to receive a flow of a mixture of said mud and said cuttings for initially separating said mixture into (1) a mud stream and (2) a first slurry containing said cuttings;

(b) a holding tank for receiving said mud stream from said shaker(s), said holding tank having a plurality of bins divided by mud return equalizers for the progressive movement of said mud stream through a desander, a desilter, and a mud cleaner;

(c) a classifier/grit dewatering unit for receiving said slurry and separating said cuttings from said slurry to obtain a drill solids discharge, said dewatering unit also being adapted to receive effluent from said desander, said desilter, and said mud cleaner and further separate said effluent, said dewatering unit having a variable speed motor driving screw feeder to move said drill solids discharge from said unit and said unit being adapted to connect to a centrifuge pump for returning settled mud to said mud cleaning pit;

(d) a rotating, heat-jacketed trundle for receiving and heating said drill solids discharge for a time and at a temperature sufficient to vaporize said hydrocarbon contaminants to obtain (1) processed solids and (2) hydrocarbon vapors;

(e) means to capture said hydrocarbon vapors;

(f) a condenser for condensing said hydrocarbon vapors to obtain a liquid hydrocarbon; and (g) means for transporting said liquid hydrocarbon from said condenser to said holding tank for admixture with said mud stream.

* * * * *